United States Patent [19]

Ermer et al.

[11] Patent Number: 4,628,657

[45] Date of Patent: Dec. 16, 1986

[54] CEILING AND WALL CONSTRUCTION

[75] Inventors: Bodo Ermer, Sendenhorst; Dieter Mischorr, Beckum, both of Fed. Rep. of Germany

[73] Assignee: Krupp Polysius AG, Beckum, Fed. Rep. of Germany

[21] Appl. No.: 730,780

[22] Filed: May 6, 1985

[30] Foreign Application Priority Data

May 16, 1984 [DE] Fed. Rep. of Germany ..... 3418195

[51] Int. Cl.[4] ..... E04B 1/38; F23M 5/06

[52] U.S. Cl. ..... 52/509; 52/320; 52/513; 52/611; 110/331

[58] Field of Search ..... 52/320, 321, 372, 373, 52/324, 325, 506, 509, 513, 588, 591, 593, 594, 611, 609, 610, 608; 110/331, 332, 333, 334, 335, 336, 337, 338

[56] References Cited

U.S. PATENT DOCUMENTS

| | | | |
|---|---|---|---|
| 1,440,446 | 1/1923 | Cotton | 110/332 |
| 2,524,722 | 10/1950 | Weber et al. | 110/331 |
| 2,664,837 | 1/1954 | Banck | 110/332 |

FOREIGN PATENT DOCUMENTS

| | | | |
|---|---|---|---|
| 527221 | 3/1954 | Belgium | 52/611 |
| 451191 | 9/1927 | Fed. Rep. of Germany | 110/331 |
| 20440 | 11/1955 | Fed. Rep. of Germany | 110/331 |

*Primary Examiner*—William F. Pate, III
*Assistant Examiner*—Richard Chilcot
*Attorney, Agent, or Firm*—Learman & McCulloch

[57] ABSTRACT

For gas-tight lining of a chamber which is exposed to high temperatures a ceiling and wall construction is provided which is assembled from support bars, rows of profiled bearing bricks supported thereon and central bricks inserted between these rows of bearing bricks and profiled to fit together with these bearing bricks. Support bricks which are also suitably profiled are inserted between the bearing bricks on the one hand and the central bricks on the other hand, and the central bricks have a truncated pyramid shape which tapers towards the interior of the chamber to be lined. All bricks in the construction can be replaced individually in a simple manner.

7 Claims, 10 Drawing Figures

CEILING AND WALL CONSTRUCTION

The invention relates to a ceiling and wall construction for gas-tight lining of a chamber which is exposed to high temperatures.

BACKGROUND OF THE INVENTION

Ceiling and wall constructions of the type referred to are used in particular for heat exchangers, e.g. preheaters, kilns and coolers of heat treatment apparatus and equipment, and also for boiler rooms and for ducts and the like in order to provide a gas-tight lining for the chambers thereof which are subjected to relatively high and possibly varying temperatures. A number of very different ceiling and wall constructions for the said chambers are known in the art.

In one known construction bearing bricks which are arranged adjacent to one another in tight rows are supported by parallel support bars extending at a distance from one another, and between any two adjacent rows of bearing bricks an intermediate space is formed which is filled by so-called central bricks which are also arranged adjacent to one another in rows and are inserted into the said intermediate space so as to form a seal. These central bricks and the bearing bricks which support them and are arranged in adjacent rows have on their side surfaces which face one another bearing surface profiles which are accurately complementary to one another, and in the transverse direction running between the associated bearing bricks the central bricks have a cross-section tapering towards the interior of the chamber to be lined. By contrast, the other two side surfaces of each central brick, which in each case face adjacent central bricks, run approximately vertically and parallel to one another, but they have tongue-and-groove constructions so that in each case adjacent central bricks interengage in one another. For a great variety of reasons it is necessary time and again to replace damaged or destroyed bricks by new ones. However, in the known construction described above such replacement of bricks is only possible if whole groups of bricks are removed from the ceiling and wall construction, but this is not possible without damaging or destroying further bricks.

The object of the invention, therefore, is to provide a ceiling and wall construction of the type referred to which permits simple and rapid replacement of individual bricks without damage to further bricks.

SUMMARY OF THE INVENTION

According to the present invention not only are the central bricks inserted in the intermediate space between two adjacent rows of bearing bricks, but in addition support bricks are inserted so as to be gas-tight between each pair of adjacent central bricks. These support bricks are shaped and profiled so that on the one hand they can be received and supported in the same way as the central bricks by the corresponding bearing bricks, whilst on the other hand they in their turn are profiled on the side surfaces facing the central bricks in such a way that the central bricks can be received with an accurate fit both in the intermediate spaces between adjacent rows of bearing bricks and in the intermediate spaces between adjacent support bricks. Because of this construction and because of the truncated pyramid shape of the central bricks it is possible in a simple manner to produce a ceiling or wall construction to some extent on a modular basis so that first of all the bearing bricks are lined up on the support bar, the support bricks are inserted from the exterior of the chamber to be lined into the said intermediate spaces between two adjacent rows of bearing bricks with appropriate spacing and then the central bricks are inserted with an accurate fit also from the exterior of the chamber to be lined into the intermediate spaces formed between the rows of bearing bricks and adjacent support bricks. For removal (for replacement of a damaged brick) the sequence is reversed, also in an extremely simple manner, so that any brick can be replaced individually without destroying other bricks. Because the profiles of the side surfaces of all bricks are complementary to one another a completely gas-tight lining of the relevant chamber is produced.

THE DRAWING

The invention will be described in greater detail below with reference to the accompanying drawings, wherein.

Figure 5A:
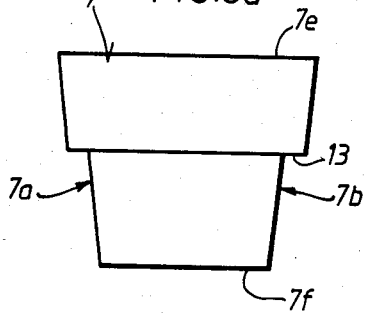
Figure 5B:
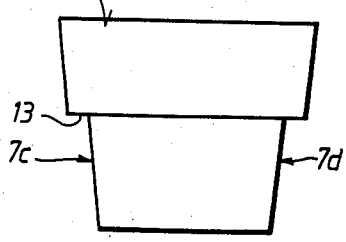
Figure 5C:
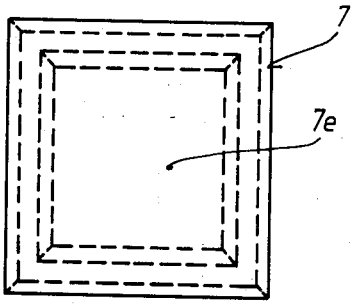
Figure 6A:
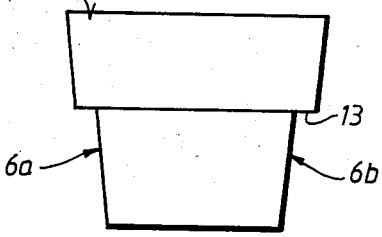
Figure 6B:
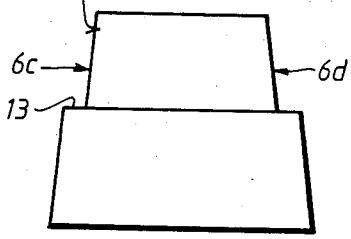
Figure 6C:
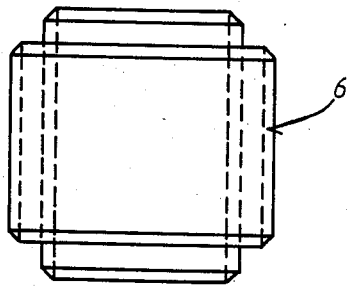

FIGS. 5*a*, 5*b* and 5*c* show a front view, side view and plan view of a central brick;

FIGS. 6*a*, 6*b* and 6*c* show a front view, side view and plan view of a support brick.

DETAILED DESCRIPTION

Before going into the details of the embodiment of the ceiling and wall construction which is illustrated in the drawings, it should be emphasised that the illustrated embodiment merely relates to a suspended ceiling for a heat exchanger chamber, particularly for a cooler housing, but that other heat exchanger chambers, furnaces, channels, ducts and the like can be provided in a similar manner with a gas-tight lining.

Figure 1:
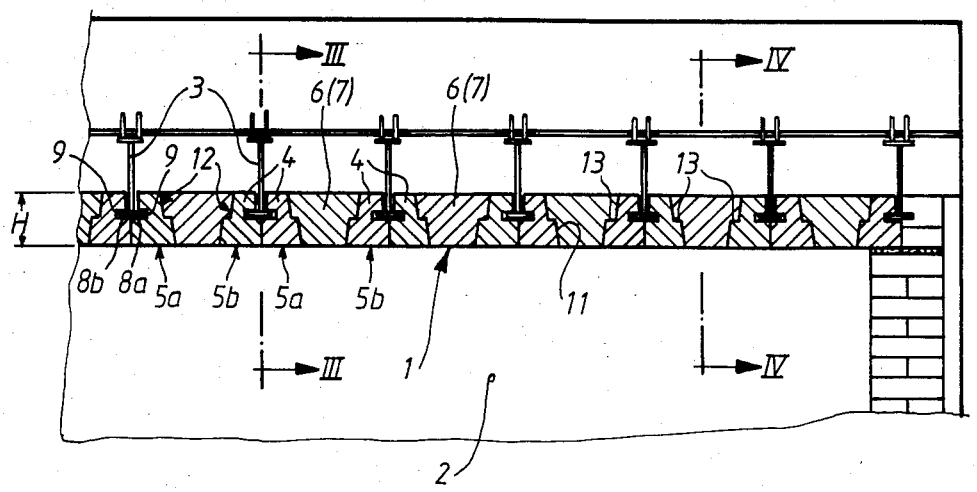
FIG. 1 shows a partial longitudinal sectional view through a chamber lined with the construction according to the invention (as a ceiling construction)

The suspended ceiling 1 shown in partial longitudinal section in FIG. 1 is associated with the housing of a cooler, for example a grate cooler or the like for burnt material, the cooling chamber 2 of which is provided with a gas-tight lining by means of this suspended ceiling 1.

The suspended ceiling 1 is assembled into one unit from parallel support members or bars 3 which are spaced from one another quadrilateral, bearing bricks 4 which are supported on the support bars 3 and are arranged in close rows 5*a*, 5*b* on the support bars 3, and quadrilateral support bricks 6 and quadrilateral central bricks 7 which are interposed between the rows 5*a*, 5*b* of bearing bricks.

The support bars 3, which are or can be mounted with their upper ends on an outer housing construction which is merely indicated, are arranged suspended and in their lower end sections which engage with the bearing bricks 4 are constructed—as shows in FIG. 1—in a T shape with two side flanges 8*a* and 8*b*.

It can also be seen in FIG. 1 that the bearing bricks 4 have on each of their side surfaces remote from the central bricks 7 or the support bricks 6 a recess 9 which is open towards the exterior, extends over the whole length of the bearing bricks 4, and accommodates the associated side flange 8*a* or 8*b* of the corresponding support bar 3 to such an extent that the bearing bricks 4 are reliably retained on these side flanges 8*a*, 8*b*, but the side flange regions which face one another of the bearing bricks of both rows of bearing bricks 5*a* and 5*b* arranged on one support bar 3 which lie below the side flanges 8*a*, 8*b* abut one another so as to be gas-tight. (cf. FIG. 1).

Figure 3:
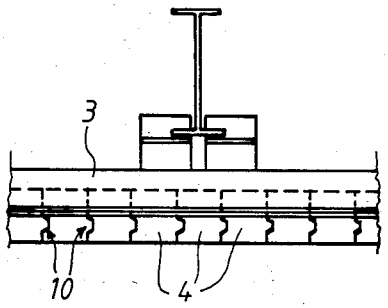
FIG. 3 shows a partial cross-sectional view along the line III—III in FIG. 1.

In addition the bearing bricks 4 of each row 5*a*, 5*b* of bearing bricks have interengaging tongue-and-groove constructions on their side surfaces which confront one another, as is shown in FIG. 3, so that the bearing bricks 4 arranged in a row 5*a*, 5*b* also abut against one another in a reliable and gas-tight manner in a direction parallel to the support bar 3.

In the region between each pair of adjacent support bars 3 the rows 5*a*, 5*b* of bearing bricks which are retained there and arranged parallel and at a distance from one another form an intermediate space 11 into which, as mentioned above, the support bricks 6 and central bricks 7 are fitted. In order to accommodate these support bricks 6 and central bricks 7 the bearing bricks 4 have on their side surface facing the intermediate space 11 (i.e. on the side surface facing away from the support bars 3) a bearing surface profile 12 which in the illustrated embodiment is inclined at an angle downwards (towards the cooling chamber 2) in such a way that each bearing brick 4 has a cross-sectional form which increases towards the bottom (cf. FIG. 1).

The central bricks 7 (FIGS. 2 and 5*c*) which are rectangular, preferably square, in plan view have a mating or complementary profile on two opposing side surfaces 7*a* and 7*b* which fits together with the bearing surface profile 12 of the bearing bricks 4, and in this transverse direction have a cross-sectional dimension which corresponds accurately to the intermediate space 11 between adjacent rows of bearing bricks 5*a* and 5*b*. In this way the central bricks which taper in cross-section in the direction towards the interior of the cooling chamber 2 to be lined are fitted accurately and in a gas-tight manner between two adjacent rows of bearing bricks 5*a*, 5*b*.

However, each central brick 7 has on its two other side surfaces 7*c* and 7*d* running at right angles to the side surfaces 7*a* and 7*b* a second mating profile which can preferably have the same profiled shape as the first mating profile on the side surfaces 7*a*, 7*b*, so that each central brick has the shape of a straight truncated pyramid with square base surfaces of which the small base surface 7*f* faces into the interior of the cooling chamber 2.

The support bricks 6 which are also fitted into the intermediate space 11 and between each pair of adjacent central bricks 7 also have on their first side surfaces 6*a* and 6*b* facing the bearing bricks 4 a side profile which is complementary to the bearing surface profile 12 of these support bricks 4. On their second side surfaces 6*c* and 6*d* facing the central bricks 7 the support bricks 6 have a bearing surface profile complementary to the second mating profiles of the central bricks 7, which thus in the present embodiment have the same profile shape as the bearing surface profile 12 of the bearing bricks 4. FIGS. 6*a* to 6*c* show the shape of the support bricks 6, according to which the cross-section of each support brick 6 tapers in the cross-sectional direction running between the bearing bricks 4, i.e. between its side surfaces 6*a* and 6*b*, towards the interior of the cooling chamber 2 to be lined, whilst the cross-section of the support brick tapers in the cross-sectional direction running between the central bricks 7, i.e. between its side surfaces 6*c* and 6*d*, towards the exterior of the cooling chamber 2, i.e. in the opposite direction. As a result of these cross-sectional shapes the support bricks 6 can be accommodated and retained so that they fit and are gas-tight in the same way as the central bricks 7 in the intermediate space 11 between the bearing bricks 4, whilst at the same time they for their part with their bearing surface profile on the side surfaces 6*c* and 6*d* form a reliable and gas-tight support for the corresponding central bricks (cf. in particular FIGS. 1, 2 and 4).

Figure 4:
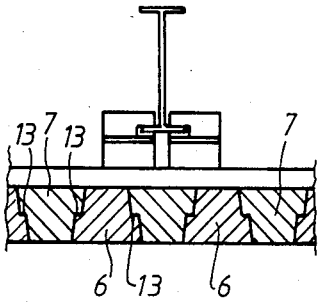
FIG. 4 shows a cross-sectional view along the line IV—IV in FIG. 1.

FIGS. 1, 3 and 4 of the drawings also show clearly that the bearing bricks 4, the support bricks 6 and the central bricks 7 all have the same height H. Furthermore, for reliable retention and gas-tight assembly of the bricks it is advantageous if all bricks 4, 6, 7 have horizontal bearing surfaces 13 harmonised with each other within their profiles at substantially midheight and at the same height.

In the assembled state the bearing bricks 4, the support bricks 6 and the central bricks 7 are arranged with their inner surfaces facing the interior of the cooling chamber 2 flush with each other.

Figure 2:
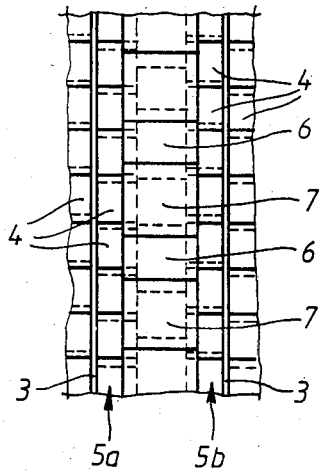
FIG. 2 shows a partial plan view of the ceiling construction according to FIG. 1.

In the construction of the suspended ceiling illustrated in the drawings and described above the ceiling construction is assembled in a simple manner as follows: First of all the bearing bricks 4 are arranged in tight rows 5*a*, 5*b* (strung together somewhat) on the side flanges 8*a*, 8*b* of the parallel support bars which are mounted the necessary distance apart, as can be seen in FIGS. 1, 2 and 3. Then the support bricks 6 and after them the central bricks 7 are inserted from above into the intermediate spaces 11 so as to produce the suspended ceiling which provides reliable support and a gas-tight seal.

It has already been made clear above that the construction according to the invention can be used to provide a gas-tight lining for chambers of differing construction from the illustrated cooling chamber 2. Furthermore it should be emphasised that the construction described on the basis of a suspended ceiling can of course be used not only purely as ceiling construction but in a similar manner can also be used as a wall construction and furthermore the ceiling does not of course have to be essentially horizontal but can also be curved or inclined.

We claim:

1. A gas-tight lining construction for the ceiling and wall of a chamber exposed to high temperatures, said construction comprising spaced apart, parallel support members; a corresponding plurality of spaced apart, parallel rows of bearing bricks supported by said support members, each of said bearing bricks having on that side confronting an adjacent row a bearing surface profile; a plurality of quadrilateral, spaced apart central bricks interposed between two adjacent rows of said bearing bricks, each of said central bricks having a bearing surface profile on that side which confronts the adjacent row of bearing bricks and is supported by the bearing surface profile of such bearing bricks, each of said central bricks having on each of its other two sides a bearing surface profile supported by the bearing surface profile of the adjacent bearing brick; and a quadrilateral support brick accommodated in the space between each two adjacent central bricks, each side of each support brick which confronts a central brick having a bearing surface profile supporting the bearing surface profile of the adjacent central brick, each of said support bricks having on each of its other two sides a bearing surface profile supported by the bearing surface profile on the adjacent bearing brick, the confronting sides of said bearing bricks and said central bricks abutting one another and being complementally tapered, and the confronting sides of said central bricks and said support bricks abutting one another and being complementally tapered.

2. The construction as claimed in claim 1 wherein each central brick has the shape of a truncated pyramid with square base surfaces.

3. The construction as claimed in claim 1 wherein each support brick has a cross section that tapers towards the interior of the chamber in the cross-sectional direction extending between the bearing bricks whereas in the cross-sectional direction extending between the central bricks it tapers towards the exterior of the chamber.

4. The construction as claimed in claim 1 wherein the bearing bricks, the central bricks, and the support bricks are of substantially the same height.

5. The construction as claimed in claim 1 wherein each bearing surface profile of each of said bricks is located substantially midway of its height.

6. The construction as claimed in claim 1 wherein each of said bearing bricks has in its side surface remote from the adjacent central brick an open recess for the accommodation of said support member.

7. The construction as claimed in claim 1 wherein the bearing bricks of each row have interengaging tongues and grooves on their confronting sides.

* * * * *